United States Patent [19]

Grosse-Plankermann

[11] 4,059,954

[45] Nov. 29, 1977

[54] LABORATORY CLOCK

[75] Inventor: Wilhelm Grosse-Plankermann, Unterhaching, Germany

[73] Assignee: Hauck GmbH, Germany

[21] Appl. No.: 689,825

[22] Filed: May 25, 1976

[30] Foreign Application Priority Data

Jan. 13, 1976 Germany ..... 7600670[U]

[51] Int. Cl.[2] ..... G04B 13/00

[52] U.S. Cl. ..... 58/21.13; 58/39.5; 58/22.9

[58] Field of Search ..... 58/21.13, 22.9, 21.15, 58/22, 39.5

[56] References Cited

U.S. PATENT DOCUMENTS

| | | | |
|---|---|---|---|
| 2,949,170 | 8/1960 | Meter | 58/21.13 |
| 3,431,120 | 3/1969 | Ehner et al. | 58/22.9 |
| 3,552,115 | 1/1971 | Losert | 58/22.9 |
| 3,568,429 | 3/1971 | DeLillie | 58/22.9 |

*Primary Examiner*—Robert K. Schaefer
*Assistant Examiner*—Jit W. Miska
*Attorney, Agent, or Firm*—Brumbaugh, Graves, Donohue & Raymond

[57] ABSTRACT

A timer includes a pointer settable to a predetermined position representing a desired time interval. Upon actuation of the timer, the pointer runs from the predetermined position to a zero position, the timer being automatically stopped when the pointer reaches the zero position. In order that the timer may also be used as a stop watch or program timepiece, it is also provided with a switch mechanism for selectively changing the direction of travel of the pointer so that the pointer runs away from the zero position and a manually actuable stop lever for stopping the timer.

18 Claims, 23 Drawing Figures

FIG. 5
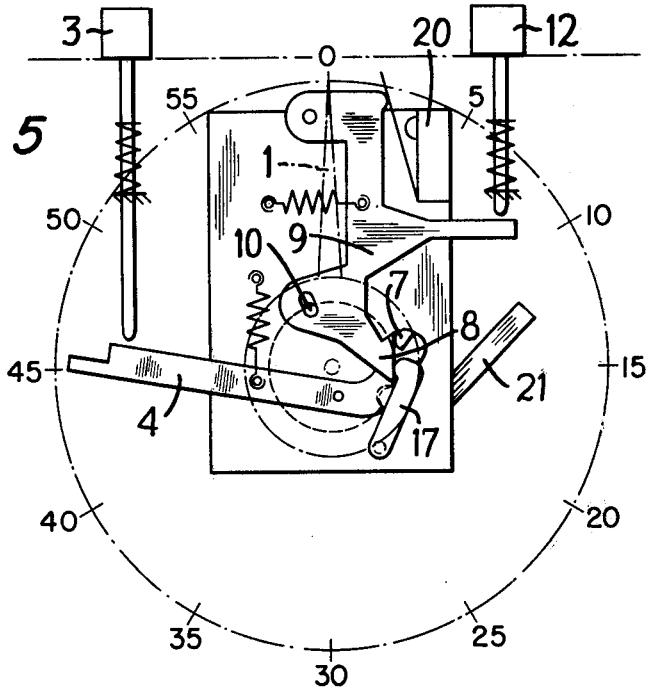
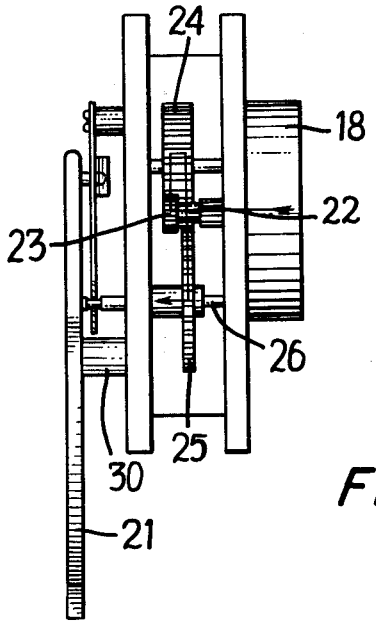
FIG. 6

LABORATORY CLOCK

BACKGROUND OF THE INVENTION

The present invention relates essentially to a timer, and, more particularly, to a timer used in laboratories to set predetermined intervals of time and signal their elapse or to switch equipment on for definite lengths of time. Such timers may, for example, be used in photographic laboratories, where they serve to accurately measure the exposure time or length of treatment of films or papers in baths.

Ordinarily, the laboratory timers are preset to a desired interval of time by means of pointers. After actuation of a start key, the pointers run from their preset position to a zero position, where the timer stops. During the period of time that the timer is running, a contact is closed so that a piece of laboratory equipment may be kept operating for that period.

However, one disadvantage of these prior art timers is that they are only capable of operating as timers for measuring preset intervals of time. Thus, timers have been incapable, heretofore, of operating as a stop watch or program timepiece and this could not be used to measure the duration of processes or even execute an entire switching program with a plurality of successive switching intervals of different lengths.

SUMMARY OF THE INVENTION

It is an object of the present invention to provide a timer which avoids the difficulties and disadvantages of the prior art timers noted above.

This object, as well as other objects which will become apparent in the discussion that follows, are achieved, according to the present invention, in a timer having a motor capable of driving a pointer through a transmission gear train. The pointer is settable to a predetermined position representing a desired time interval. A start level actuates the motor so that the pointer runs back to a zero position from the predetermined position. When the pointer reaches the zero position, a trip mechanism automatically actuates a stop lever to stop the motor.

In accordance with the present invention, a switch lever, acting through the gear train, is provided for selectively changing the direction of travel of the pointer so that the pointer runs away from the zero position. The switch lever is coupled to the trip mechanism so as to prevent the trip mechanism from actuating the stop lever when the pointer runs away from the zero position. However, the motor may be stopped by manually actuating the stop lever.

Thus, when the pointer runs back toward the zero position, in the conventional manner, the timer is capable of measuring preset intervals of time and indicating the remainder of the preset interval at any given moment. By running the pointer away from the zero position, time intervals are measured progressively so that the timer may be operated as a stop watch as well as a conventional timer. Actuation of the start and stop levers allows the beginning and end of the timer interval to be fixed as in conventional stop watches.

In accordance with another embodiment of the present invention, a program disc is attached to the pointer or the pointer axis for movement therewith. The program disc may be provided with adjustable tabs for preselecting desired time intervals which elapse successively. The stop lever includes a pin protruding into the path of the tabs as the program disc moves with the pointer. The tabs successively engage the pin to actuate the stop lever and stop the motor. Accordingly, initial actuation of the start lever initiates the first time interval which is terminated when the first tab engages the pin. Ensuing actuation of the start lever initiates the next time interval which is terminated when the next tab engages the pin. In order to signal the elapse of the time intervals, an alarm sounds at the expiration of each time interval. Alternatively, the alarm may be sounded shortly before the elapse of each time interval.

Preferably, the program disc is replaceable so that a plurality of program disc may be prepared for various purposes and a disc corresponding to a desired program can be installed at will. In contrast to conventional timers, the present invention permits important simplifications in the time control of processes having different durations, since preset time intervals will run off in preselected sequence by simply actuating the timer. Thus, new time intervals need not be set after the elapse of each preceding time interval.

BRIEF DESCRIPTION OF THE DRAWING

For a further understanding of the present invention, reference may be had to the accompanying drawing, in which:

FIGS. 1–5 are diagrammatic illustrations of a timer in accordance with the present invention operating in conventional timing mode;

FIG. 6 is a side schematic diagram of a timer operating in conventional timing mode;

DESCRIPTION OF THE PREFERRED EMBODIMENTS

Figure 1:
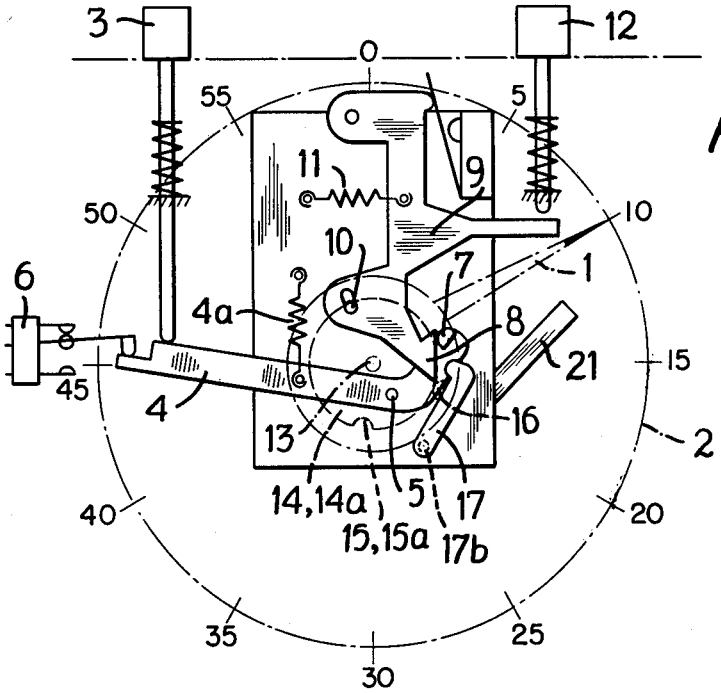

Referring now to FIG. 1, there is shown a pointer or hand 1 preset to a time interval of 10 units, for example ten minutes, on a scale 2 graduated in 60 units. A start lever 4, pivotable about a shaft 5 and actuable by a spring mounted start key 3, is spring-biased into a rest position in which two upper contacts of a set of contacts 6 are closed. By way of this set of contacts 6, receptacles built into the timer may be connected to or disconnected from a source of voltage so that appliances plugged into the receptacles will be powered for predetermined time intervals or, alternatively, not powered. The start lever 4 is spring-biased into the rest position by a spring **4*a*. The end of the start lever 4 opposite the end engaged by the start key 3 has a projection 7 which extends perpendicularly outward from the start lever 4. The projection 7 cooperates with a lug 8 on a stop lever 9 which is rotatably mounted about a pivot pin 10 slidably retained in an oblong slot in the stop lever 9. A spring 11 biases the stop lever 9 into a rest position in which the pivot pin 10 engages the lower end of the oblong hole in the stop lever 9. The stop lever 9 rotates clockwise about the pivot pin 10 when actuated by a spring-mounted stop key 12**.

The pointer 1 and a disc 14 having a recess 15 rotate about a shaft 13. A first trip lever 17*a* (see FIG. 7) having a cog 16 capable of mating with the recess 15 is connected by a common shaft 17*b* to a second trip lever 17. The cog 16 slides along the rim of the disc 14 as it rotates about the shaft 13. When the pointer 1 reaches the zero position, the recess 15 mates with the cog 16, as will be further explained below.

Figure 10:
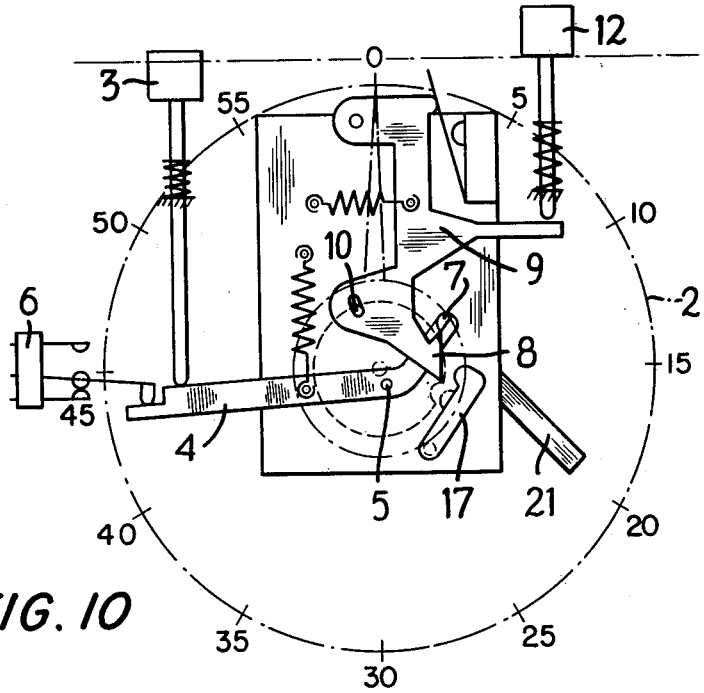

As shown in FIG. 1, an interval of 10 units of time, for example 10 minutes, may be set by manually rotating the pointer 1 to the figure 10 on the scale 2. The top contacts of the set of contacts 6 are closed and the bottom contacts are open so that a receptacle connected to the voltage source through the bottom contacts remains unenergized.

Figure 2:
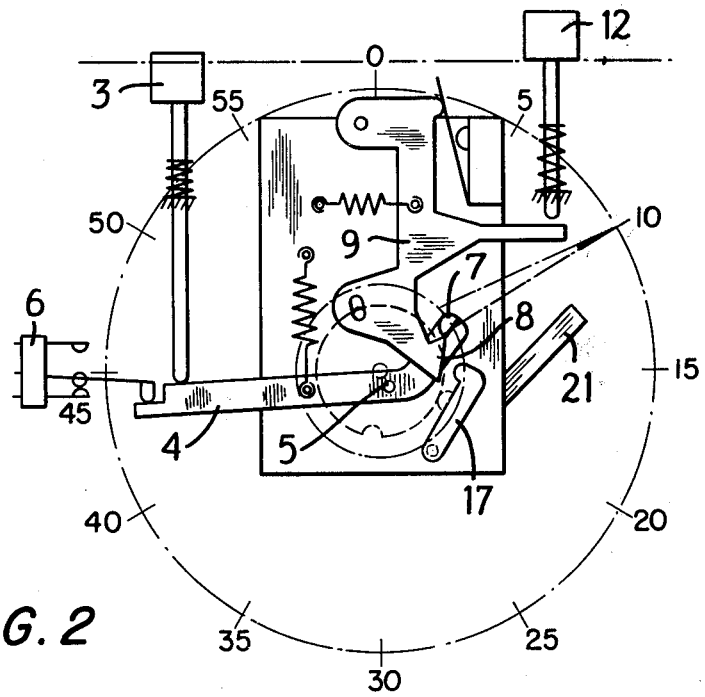

In FIG. 2, the start key 3 has been depressed, rotating the start lever 4 counterclockwise about the shaft 5. This opens the top contacts of the set of contacts 6. When the start lever 4 is rotated to the position shown in FIG. 2, the projection 7 on the start lever 4 slides over the edge of the lug 8 of the stop lever 9. In such a position, the start lever 4 simultaneously closes the bottom contacts of the set of contacts 6, thereby connecting the voltage source to a synchronous motor 18 (see FIGS. 6 and 8) to activate the timer.

Figure 3:
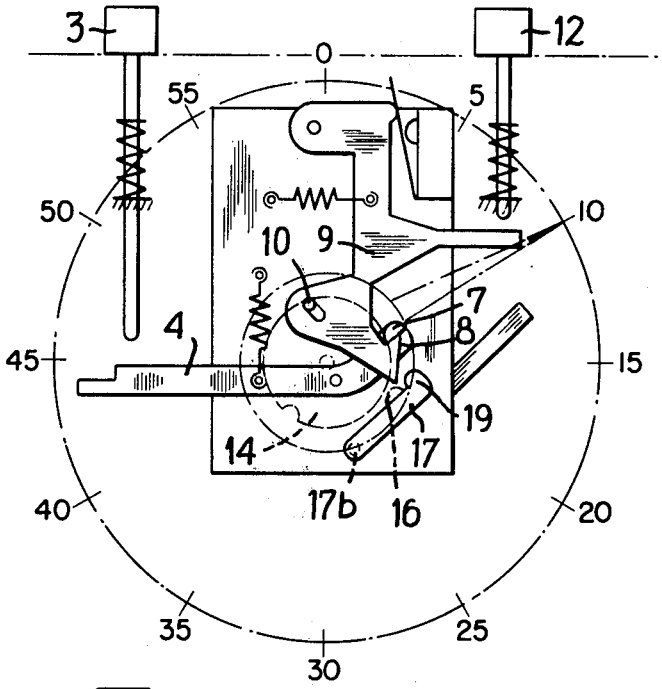
Figure 4:
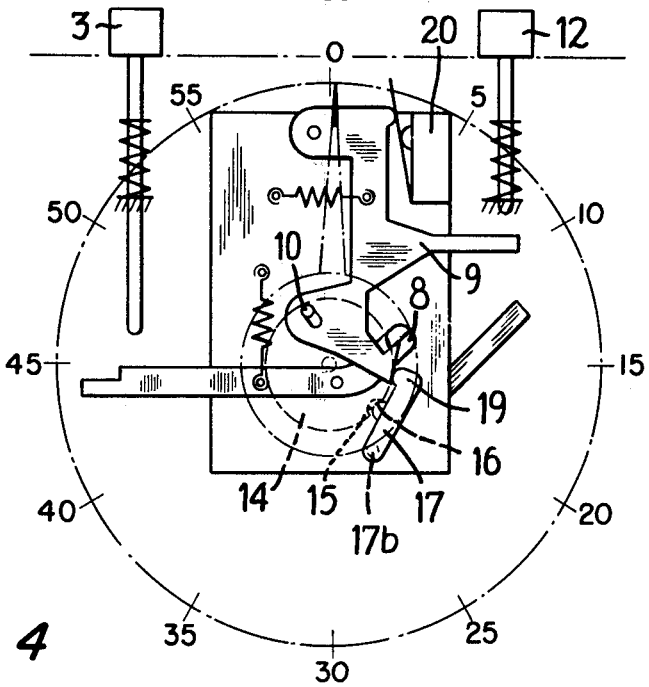

Referring now to FIG. 3, once the timer is activated, the projection 7 on the start lever 4 engages the lug 8 of the stop lever 9, the lug 8 holding the start lever 4 in the operating position shown in FIGS. 2 to 4 during the elapse of the predeterminedtime interval. At the same time, the start lever 4 draws the stop lever 9 downward, until the pivot pin 10 engages the upper end of the oblong hole in the stop lever 9. In the operating position, the bottom contacts of the set of contacts 6 are kept closed by the start lever 4.

During the elapse of the predetermined time interval, the cog 16 on the first trip lever 17*a* slides along the rim of the disc 14 until, at the end of the time interval, the recess 15 on the disc 14 reaches the cog 16 (see FIG. 4). Just prior to the end of the time interval, the upper end of the stop clockwise rotated lever 9 closes a contact spring of a microswitch 20 (see FIG. 4) to sound an alarm, for example a buzzer, signalling the imminent end of the predetermined time interval.

At the end of the time interval, the cog 16 of the first trip lever 17*a* mates with the recess 15 on the disc 14, causing the second trip lever 17 to rotate counterclockwise so that a cog 19 on the end of the second trip lever 17 engages the lug 8 of the stop lever 9 and rotates it clockwise about the pivot pin 10. The clockwise rotation of the stop lever 9 disengages the lug 8 from the projection 7 on the start lever 4, whereby the stop lever 9 is drawn back into its rest position by the spring 11 (see FIG. 5). At the same time, the start lever 4 is drawn back to its rest position (see FIGS. 1 and 5) by the spring 4*a*, opening the bottom contacts of the set of contacts 6 to cut off the supply of current to the motor 18 and stop the timer. The alarm is shut off when the stop lever 9 returns to its rest position and releases the spring contact of the microswitch 20.

FIGS. 1 to 5 show a switch lever 21 for a transmission gear train interposed between the motor 18 and the pointer 1. The flow of power through the gear train is illustrated in FIG. 6 for the operation of the timer in signal timing mode, i.e., when the pointer 1 rotates toward the zero position. More particularly, the motor 18 is fixed to a chassis through which passes a drive shaft 22 having a pinion 23 at its free end. The pinion 23 meshes with an intermediate gear 24, which in turn meshes with a gear 25. The gear 25 transmits the drive force of the motor 18 to the pointer 1 through additional transmission members (not shown). The gear 25 is rotatable about a shaft 26 which is displaceably mounted on the chassis. When the timer is operating in signal timing mode with the pointer 1 rotating toward the zero position, the shaft 26 occupies a position which permits the gear 25 to be driven by the pinion 23 through their mutual engagement with the intermediate gear 24 (see FIG. 6).

Figure 8:
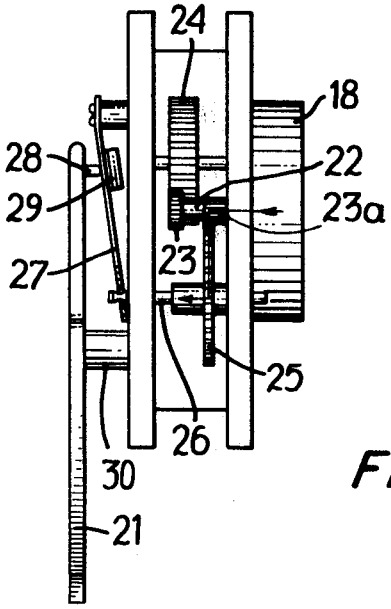
FIG. 8 is a side schematic view of the timer of FIG. 6 switched to stop watch or program mode.

In order to operate the timer in stop watch or program mode, the pointer 1 must rotate away from the zero position rather than toward it. To reverse the rotation of the pointer 1, the shaft 26 is displaced, as shown in FIG. 8, so that the gear 25 is disengaged from the intermediate gear 24 and engaged with an auxiliary pinion 23*a* positioned on the drive shaft 22 between the pinion 23 and the motor 18. The end of the shaft 26 remote from the motor 18 is journalled in a pivotable end of a leaf spring 27 so that the axial position of the shaft 26 is controlled by the position of the pivotable end of the leaf spring 27.

Figure 7:
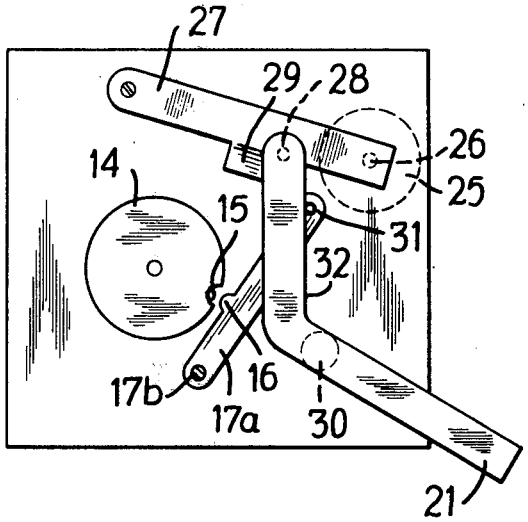
FIG. 7 is a schematic diagram of a novel switching mechanism in accordance with the present invention.

The position of the pivotable end of the leaf spring 27 is, in turn, controlled by the switch lever 21, a projection 28 of which engages an inclined slide surface 29 of the leaf spring 27. As shown in FIGS. 7 and 8, the slide surface 29, which is integral with the leaf spring 29, extends downward from the bottom edge of the leaf spring 27 and backward toward the motor 18. The position of the switch lever 21, as shown in FIG. 7, corresponds to its position illustrated in FIG. 8, where the projection 28 is forcing the leaf spring 27 out of a rest position shown in FIG. 6. The leaf spring 27 assumes the rest position shown in FIG. 6, when the switch lever 21 is rotated counterclockwise about a pivot 30 (see FIG. 7), so that the projection 28 engages the end of the slide surface 29.

In signal timing mode, as shown in FIG. 6, power flows, as illustrated by the arrow, from the motor 18 through the intermediate gear 24 to the gear 25 in such a manner that the gear 25 rotates in the same direction as the motor shaft 22. Conversely, in stop watch and program mode, as shown in FIG. 8, the power flows, as illustrated by the arrow, directly from the motor 18 to the gear 25 so that the gear 25 rotates in a direction opposite to that of the motor shaft 22. Thus, the direction of rotation of the gear 25 and, hence, the pointer 1 can be reversed without changing the direction of rotation of the motor 18.

As shown in FIG. 7, the first trip lever 17*a* is disengaged from the disc 14 simultaneously with the switching of the timer into stop watch or program mode. This is accomplished by providing the first trip lever 17*a* with a pin 31 at its pivotable end, the first trip lever 17*a* being rotated clockwise through the sliding engagement of a side surface 32 of the switch lever 21 and the pin 31 when the switch lever 21 rotates clockwise about the pivot 30. The clockwise rotation of the first trip lever 17*a* lifts the cog 16 off the rim of the disc 14 so that the cog 16 is prevented from mating with the recess 15 on the disc 14. Inasmuch as the second trip lever 17 also rotates clockwise about the shaft 17*b*, the cog 19 on the second trip lever 17 is brought out of reach of the lug 8 of the stop lever 9 (see FIG. 9). Hence, when the gear 25 meshes with the auxiliary pinion 23*a*, the stop lever 9 can no longer be actuated by the second trip lever 17.

Figure 9:
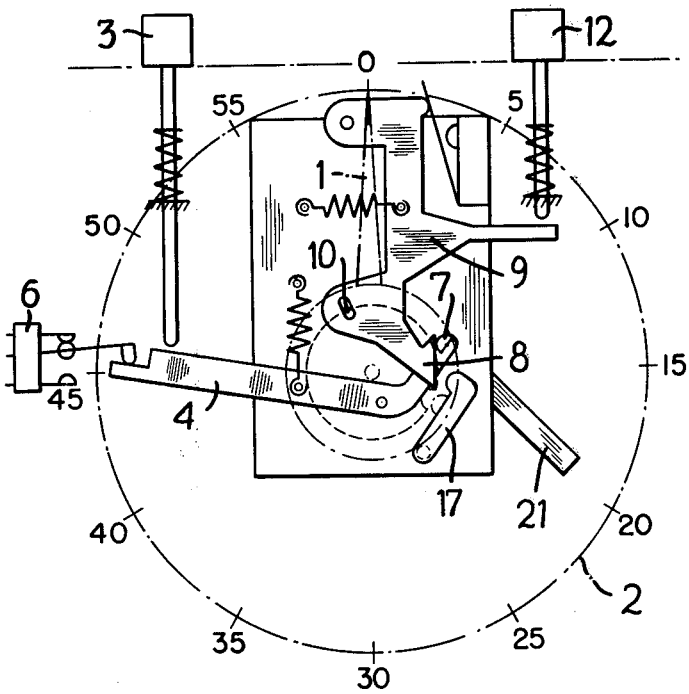
FIG. 9–12 are diagrammatic illustrations of the timer of FIGS. 1–5 operating in stop watch mode.

The following discussion of FIGS. 9–12 will describe the operation of the timer as a stop watch in greater detail. As shown in FIG. 9, the start key 3 has not been depressed. The start lever 4 is, therefore, still in its rest position with the top contacts of the set of contacts 6 closed and the bottom contacts opened. The projection 7 on the start lever 4 is still in front of the lug 8 of the stop lever 9. The pointer 1 is in the zero position on the scale 2. As compared to FIGS. 1 to 5, the switch lever 21 occupies a new position due to its clockwise rotation.

If the start key 3 is depressed, as shown in FIG. 10, the start lever 4 is rotated counterclockwise about the shaft 5, opening the top contacts of the set of contacts 6 and closing the bottom contacts. The projection 7 on the start lever 4 slips over the edge of the lug 8 of the stop lever 9 and slides into engagement with the lug 8 (see FIG. 11).

Upon the release of the start key 3, it returns to its initial position, and the spring 4*a* rotates the start lever 4 clockwise about the shaft 5 a distance insufficient to open the bottom contacts of the set of contacts 6. The projection 7, engaging the lug 8, simultaneously pulls the stop lever 9 downward so that the pivot pin 10 engages the upper end of the oblong hole in the stop lever 9. Inasmuch as the start lever 4 is prevented from moving from this position, the bottom contacts of the set of contacts 6 remain closed and the motor 18 remains activated so that the timer operates as a stop watch.

Figure 11:
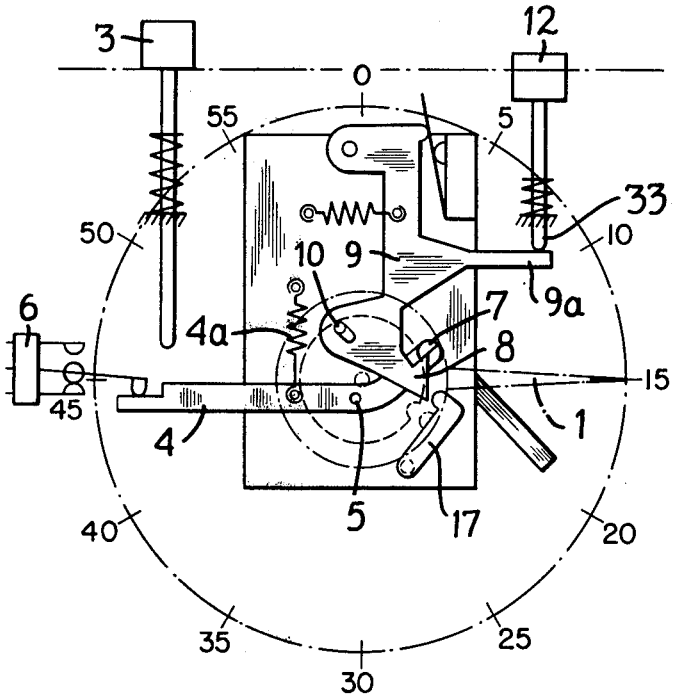

After a measured time interval, the timer is stopped be depressing the stop key 12, which in FIG. 11 has already been depressed a short distance from its initial position. A pin 33 of stop key 12 presses against an arm 9*a* of the stop lever 9, which is thereby rotated clockwise about the pivot pin 10. The lug 8 is thus disengaged from the projection 7 on the start lever 4 so that the start lever 4 is drawn back into its rest position by the spring 4*a* (see FIG. 12). This closes the top contacts of the set of contacts 6 and opens the bottom contacts so that the motor 18 is de-energized to stop the timer.

Figure 12:
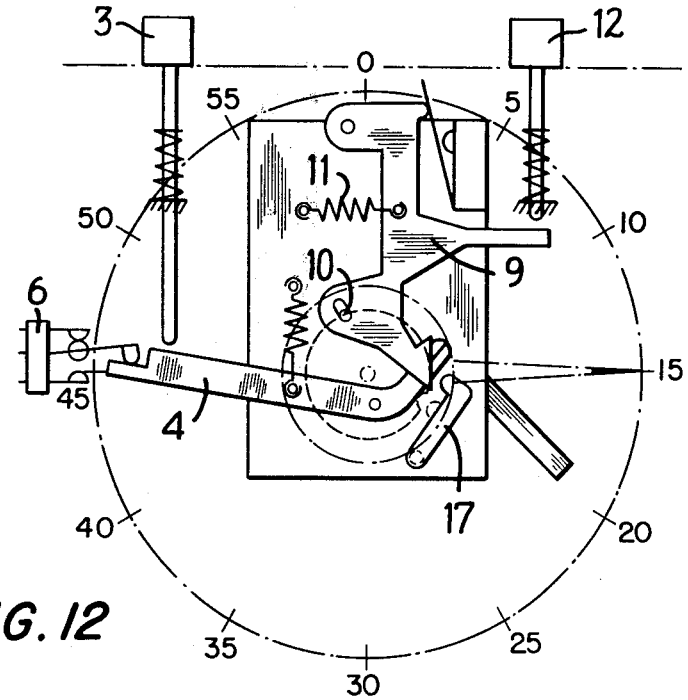

In FIGS. 11 and 12, the measured time interval is 15 minutes, as the position of the pointer 1 indicates. When the timer stops, the stop lever 9 is drawn back into its rest position by the spring 11. As explained above, the second trip lever 17 is rendered inactive in the stop watch mode so that the cog 19 cannot engage the lug 8 of the stop lever 9 to initiate the automatic deactivation of the timer.

When the gear 25 is driven by the auxiliary pinion 23*a*, the timer may also be operated as a program clock. Referring now to FIGS. 13 to 16, a program disc 34 is mounted on the shaft 13. The periphery of the program disc 34 is studded with adjustable tabs in the form of slip-on riders 35. The timer is started in the same manner as in the stop watch mode by pressing the start key 3 to bring the start lever 4 into the position shown in FIG. 13 which corresponds to that of FIG. 11.

Figure 13:
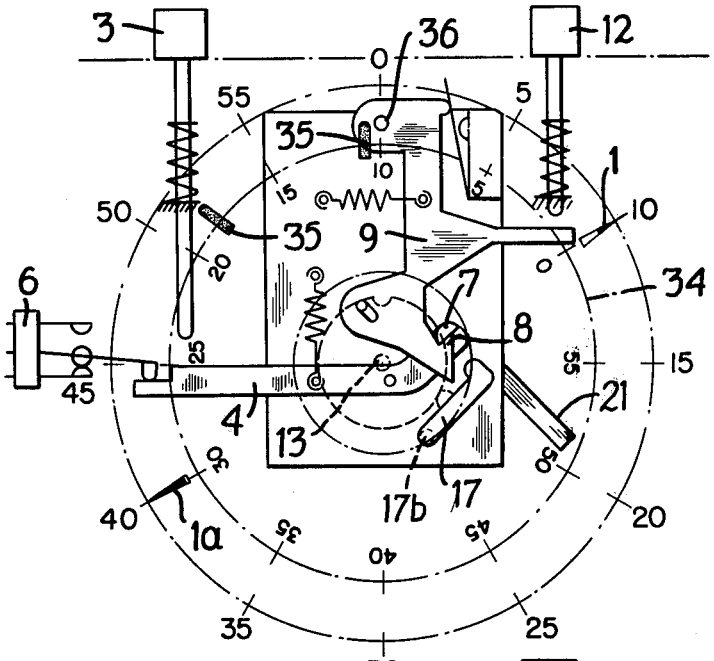
FIGS. 13–16 are diagrammatic illustrations of the timer of FIGS. 1–5 operating in program mode.

According to FIG. 13, the first program interval has been preselected to be 11 minutes, as illustrated by the position of the top rider 35 which is shown about to touch a pin 36 protruding from the bottom surface of the stop lever 9. Since the projection 7 on the start lever 4 is still engaged by the lug 8 and the start lever 4 is, thus, still fixed in its operating position, the bottom contacts of the set of contacts 6 are closed and the motor 18 is supplied with current.

Figure 14:
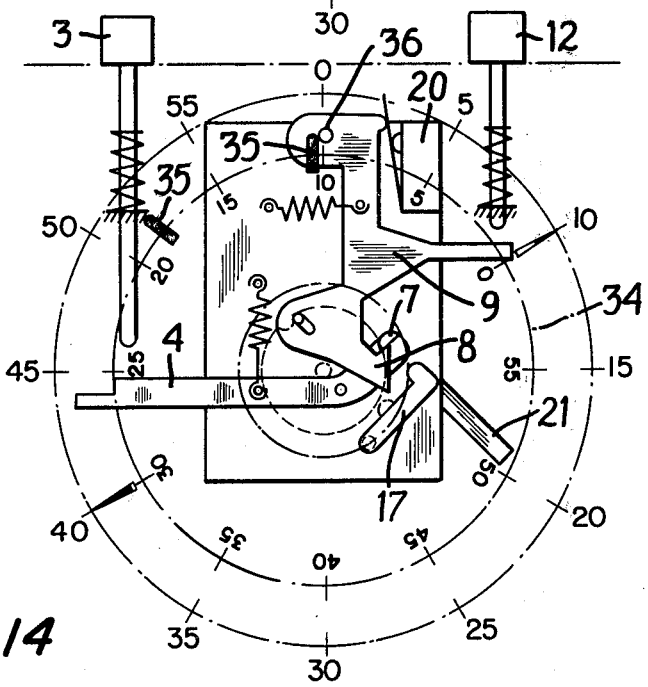

In FIG. 14, after a further short period of time, the top rider 35 engages the pin 36 of the stop lever 9 rotating the stop lever 9 clockwise and closing the contact spring of the microswitch 20 to sound an alarm. The slight clockwise rotation of the stop lever 9, causes the lug 8 of the stop lever 9 to begin to move away from the projection 7 on the start lever 4.

Figure 15:
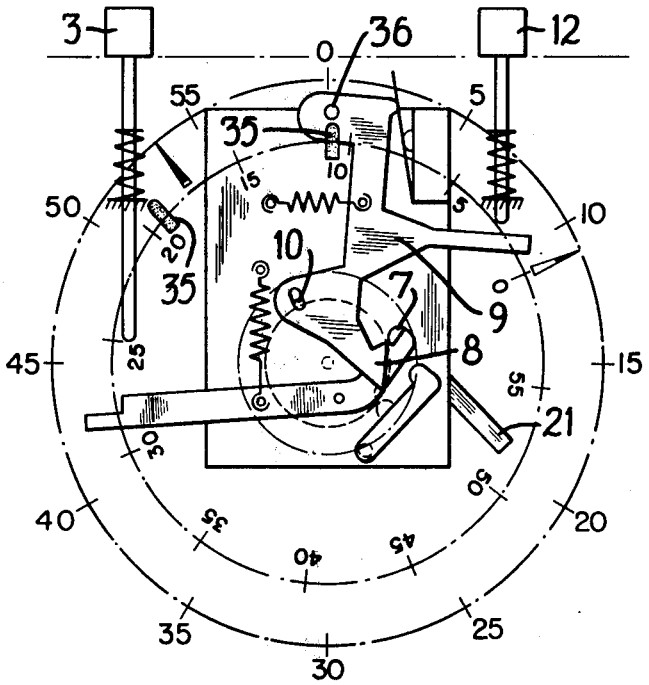
Figure 16:
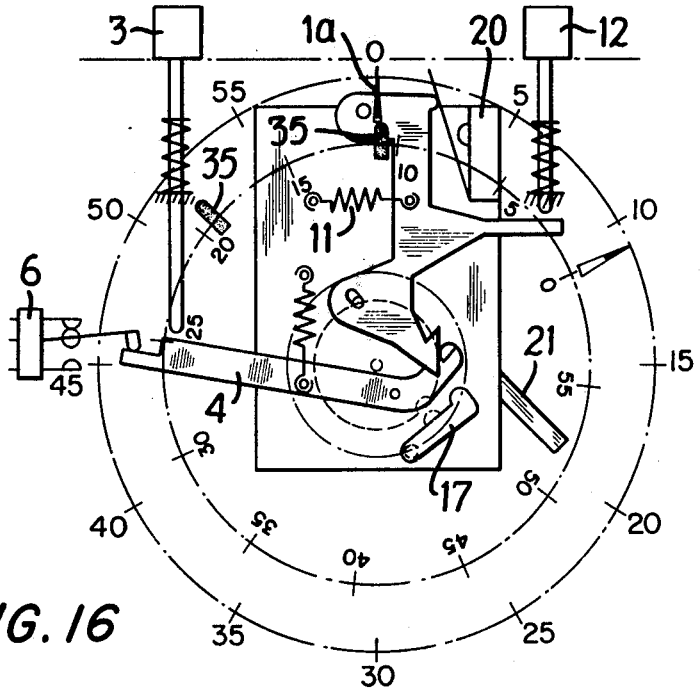

In the position shown in FIG. 15, the projection 7 on the start lever 4 is completely disengaged from the lug 8. This is accomplished by the further clockwise rotation of the pin 36 whereby the stop lever 9 moves slightly upward so that the pin 36 is positioned over the top rider 35. After the release of the lug 8 by the projection 7, the stop lever 9 returns to its rest position by the biasing action of the spring 11 (see FIG. 16), whereby the microswitch 20 is opened to deactivate the alarm. The start lever 4 also returns to its rest position, opening the bottom contacts of the set of contacts 6 so that the motor 18 is deactivated to stop the timer after the elapse of the first program time interval of 11 minutes.

When the start key 3 is pressed again, the timer runs in the same manner as described above with reference to FIG. 9 for the stop watch mode, until the next rider 35 reaches the pin 36 of the stop lever 9 and stops the timer, in the manner just described, after the elapse of the second program time interval of 8 minutes, i.e., from scale position 11 to scale position 19 on the program disc 34. The number of program time intervals is practically unrestricted, and if the program disc 34 is placed on the shaft 13 of the pointer 1, a complete program of up to 60 minutes can be composed of one or more program time intervals of predetermined length by distributing the riders 35 with the desired spacing around the periphery of the program disc 34. Each program time interval is initiated manually by depressing the start key 3 and terminated automatically when the corresponding rider 35 actuates the stop lever 9 by engaging the pin 36.

Another aspect of the present invention, shown in FIGS. 17 to 20, involves an improved mechanism for a more accurately timed stopping of the timer at the end of the program time intervals. Referring now to FIGS. 17 to 20, the start lever 4 is set free to return to its rest position only when a second pointer or hand 1*a* (see FIG. 16) is at 0 seconds or 30 seconds so that the program time intervals can be set exactly by half-minute increments. For this purpose, the shaft 13 carries a notched disc 37 having a pair of notches 37*a*. The notched disc 37 rotates together with the second pointer 1*a* (see FIG. 16), and along its periphery slides a follower 38 pivotably mounted on a follower lever 39. The follower lever 39 is rotatably mounted on a pivot 40 and biased by a spring 41 in such a manner that the follower 38 rests on the periphery of the notched disc 37.

At the end of the follower lever 39 opposite the follower 38, a pin 42 is mounted in such a manner that it may engage a slide surface 43 on a pawl 44. The pawl 44 is mounted for rotation about a pivot 45. A lug 46 on the pawl 44 is capable of engaging the projection 7 on the start lever 4. In this way, the projection 7 on the start lever 4 may be engaged not only by the lug 8 of the stop lever 9 but also by the lug 46 of the pawl 44 so that the start lever 4 can be drawn back into its rest position by the spring 4*a* only when both the lug 8 and the lug 46 disengage the projection 7 on the start lever 4.

Figure 17:
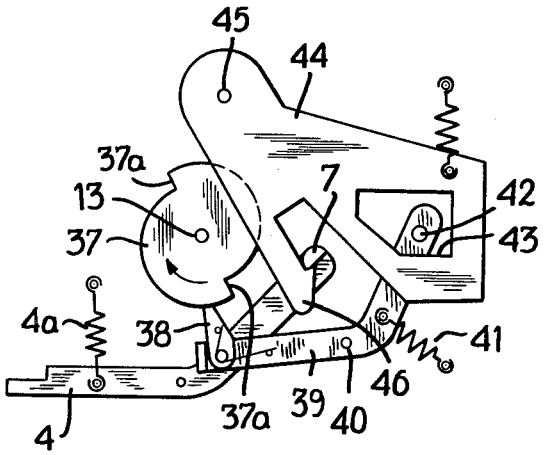
FIGS. 17–20 are schematic diagrams of an alternate embodiment of the present invention.
Figure 18:
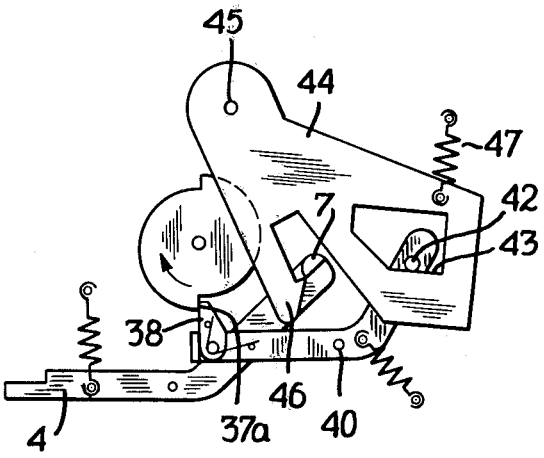
Figure 19:
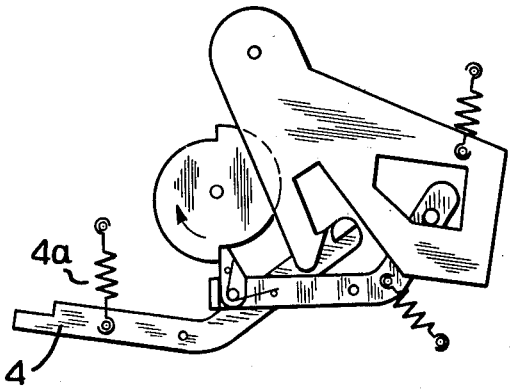

In the position shown in FIG. 17, the bottom notch 37*a* of the notched disc 37, which is rotating in the direction of the arrow, has not reached the follower 38 of the follower lever 39. In FIG. 18, however, the follower 38 has slipped into one of the notches 37*a*. Thus, the follower lever 39 has rotated slightly clockwise about the pivot 40, and the pin 42 has rotated the pawl 44 clockwise about the pivot 45 through engagement of the slide surface 43 by the pin 42. By rotating the pawl 44 clockwise about the pivot 45, the lug 46 is disengaged from the projection 7 so that the start lever 4 is released and returned to its rest position, as illustrated in FIG. 19.

Considering the practically unavoidable manufacturing tolerances on such parts as the stop lever 9, the oblong hole in the stop lever 9, the program disc 34 and the riders 35, timing errors of a few seconds are difficult to prevent in practice. Thus, the additional feature of using the second pointer 1*a* for the automatic termination of the program time intervals provides a substantial improvement in the precision of the timer.

Figure 20:
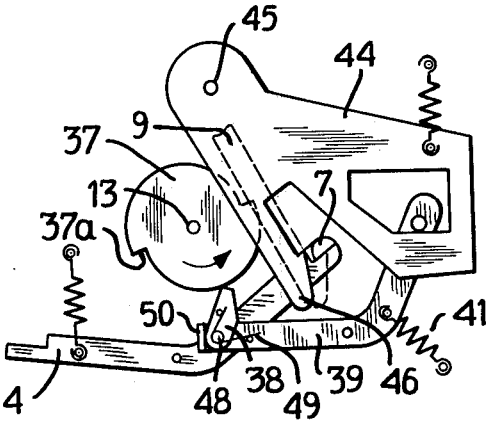

When the timer is operating in switch or signal timing mode, as shown in FIG. 20, with the pointers 1 and 1*a* and the notched disc 37 rotating counterclockwise, the follower 38 must be prevented from being caught in one of the notches 37*a*. To accomplish this, the follower 38 is mounted for pivotable movement in one direction on the follower lever 39 by a pin 48. A spring 49 biases the follower 38 against a stop 50 at the end of the follower lever 39. As the notched disc 37 rotates counterclockwise, the follower 38 is pivoted in a clockwise direction when acted upon by a notch 37*a* on the notched disc 37.

In switch and signal timing mode, the pawl 44 is pivoted so that the lug 46 cannot be engaged by the protection 7 on the start lever 4, at least when the pointers 1 and 1*a* approach the zero position. In this way, the projection 7 may cooperate exclusively with the lug 8 of the stop lever 9 in the manner described during the discussion of switch and signal timing mode with reference to FIGS. 1 to 5. Alternatively, the cog 19 of the second trip lever 17 may be designed of sufficient width so that it can push aside both the lug 8 and the lug 46 at the same time.

Figure 21:
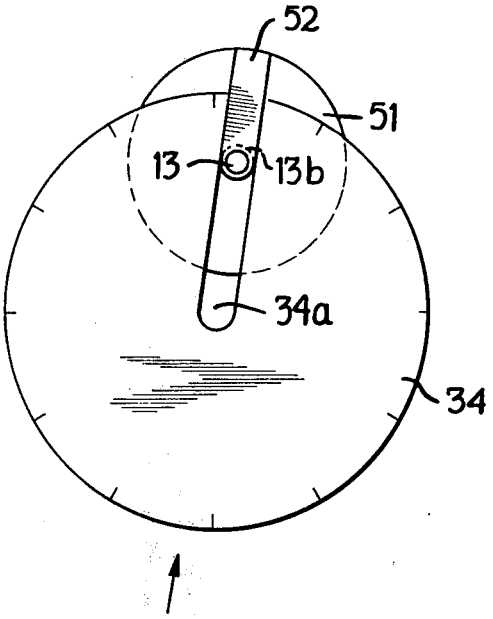
FIG. 21 shows a program disc for use with the timer of FIGS. 13–16.
Figure 22:
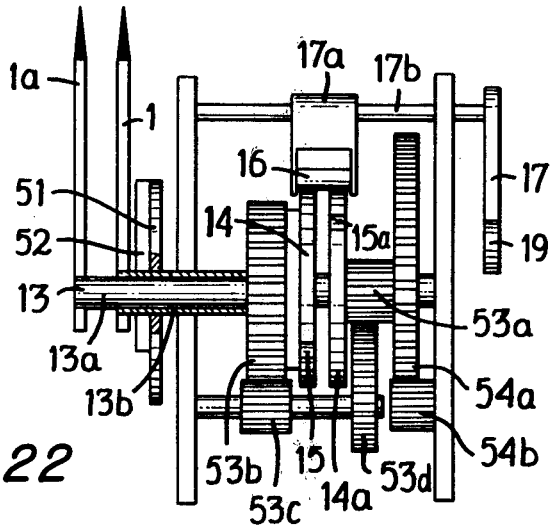
FIG. 22 is a side schematic view of a power transmission system for the alternate embodiment of FIGS. 17–20.

Referring to FIG. 21, there is shown an arrangement for mounting the program disc 34 on the shaft 13. As shown, the shaft 13 carries a program disc wheel 51. In FIG. 22, the program disc wheel 51 is mounted on a hollow shaft 13*b* of the pointer 1 so that it rotates with the hollow shaft 13*b* and the pointer 1. The program disc wheel 51 has a key 52 projecting beyond its upper surface in such a manner that the key 52 is capable of mating with a complimentarily shaped slit 34*a* in the program disc 34. Thus, the program disc 34 can be pushed onto the program disc wheel 51 in the direction of the arrow, the slit 34*a* receiving the key 52 to firmly seat the program disc 34 on the program disc wheel 51. When the program disc wheel 51 rotates with the hollow shaft 13*b*, the program disc 34 is simultaneously rotated by the wheel 51 so that the program disc 34 rotates along with the pointer 1.

As shown in FIG. 22, the second pointer 1*a* is mounted on a shaft 13*a* which passes through the hollow shaft 13*b* coaxially therewith. The shafts 13*a* and 13*b* are linked by gears 53*a*, 53*b*, 53*c* and 53*d* in a transmission ratio of 1:60, gear 53*a* being fixed to the shaft 13*a* and gear 53*b* to the shaft 13*b*. The shaft 13*a* likewise carries a drive gear 54*a*, driven by a pinion 54*b*, which in turn is powered by the motor 18 through the transmission gear train described with reference to FIGS. 6 and 8.

The disc 14, with the groove 15 on its rim, is also fixed for rotation with the shaft 13*b*. A similar disc 14*a* with a groove 15*a* is fixed for rotation with the shaft 13*a*. Over the rim of the discs 14 and 14*a* slides the cog 16 of the first trip lever 17*a*, which is connected to the second trip lever 17 by way of the shaft 17*b*. In the zero position of the pointers 1 and 1*a*, the recesses 15 and 15*a* of the discs 14 and 14*a* reach the cog 16 so that the cog 16 mates with the recesses 15 and 15*a*, as previously explained with reference to FIGS. 4 and 5. In this way, the second trip lever 17 is only actuated when both of the pointers 1 and 1*a* are in the zero position, the cog 19 of the second trip lever 17 actuating the stop lever 9 by engagement with the lug 8 to stop the timer. For the sake of simplicity, the notched disc 37, which is likewise mounted on the shaft 13 and may be arranged alongside the discs 14 and 14*a*, has been omitted from FIG. 22.

Figure 23:
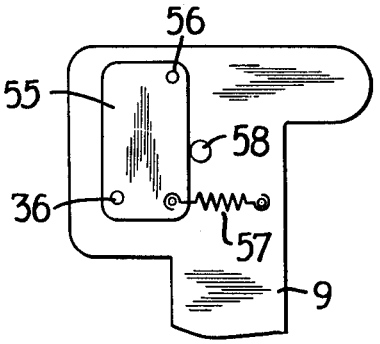
FIG. 23 shows an improved stop lever in accordance with the present invention.

In switch and signal timing mode with the pointers 1 and 1*a* rotating counterclockwise, the riders 35 would strike the pin 36 from the right, if the program disc 34 is not removed from the program disc wheel 51. Inasmuch as the stop lever 9 rests against a stop (not shown), the stop lever 9 could be jammed if the pin 36 cannot get out of the way of the riders 35. FIG. 23 shows a modified stop lever 9 capable of avoiding this problem.

As shown, the pin 36 is mounted on a separate bearing plate 55, pivotable about pivot 56 on the stop lever 9. A spring 57 biases the bearing plate 55 against a stop 58 immovably positioned on the stop lever 9. If any rider 35 strikes the pin 36 in switch of signal timing mode, the plate 55 is pivoted clockwise about the pivot 56 so that the rider 35 can pass under the pin 36. The bearing plate 55 is then drawn back against the stop 58 by the spring 57. However, in stop watch or program mode, when the pointers 1 and 1*a* are rotating clockwise, the bearing plate 55 rests against the stop 58 and, therefore, cannot move in relation to the stop lever 9, even if struck by a rider 35, so that the entire stop lever 9 is pivoted clockwise causing the timer to stop in the manner described during the explanation of stop watch and program mode.

It will be understood that the above described embodiments are merely exemplary and that persons skilled in the art may make many variations and modifications without departing from the spirit and scope of the invention. All such modifications and variations are intended to be included within the scope of the invention as defined in the appended claims.

I claim:

1. In a timer including a motor, a pointer driven by the motor through a transmission gear train, the pointer being settable to a predetermined position representing a desired time interval, a start lever for actuating the motor in such a manner that the pointer runs toward a zero position from the predetermined position and a trip mechanism for actuating a stop lever when the pointer has run back to the zero position to stop the motor, the improvement comprising:

switch means for selectively changing the direction of travel of the pointer through the gear train so that the pointer runs away from the zero position, the switch means being coupled to the trip mechanism to prevent the actuation of the stop lever by the trip mechanism when the pointer runs away from the zero position; and means for manually actuating the stop lever so that the motor can be stopped when the pointer runs away from the zero position, whereby the timer is operable as a stop watch.

2. A timer according to claim 1, further comprising a program disc mounted for movement with the pointer, adjustable tabs mounted on the program disc for preselecting desired time intervals, and a pin connected to the stop lever in such a manner that the pin protrudes into the path of the tabs as the program disc moves with the pointer so that the tabs actuate the stop lever when any one of the tabs engages the pin.

3. A timer according to claim 2, wherein the pin is integral with the stop lever.

4. A timer according to claim 2, wherein the program disc is releasably mounted for movement with the pointer.

5. A timer according to claim 4, further comprising a rotatable shaft, the pointer being mounted on the shaft for rotation therewith; a program disc wheel mounted on the shaft for rotation therewith and having a key projecting therefrom; and a radial slit in the program disc releasably engaging the key of the program disc wheel.

6. A timer according to claim 2, wherein the tabs are removably mounted on the outer edge of the program disc.

7. A timer according to claim 2, further comprising an oblong hole in the stop lever and a pivot pin extending through the oblong hole in such a manner that the oblong hole slides over the pivot pin to move the stop lever between a first position occupied by the stop lever when the motor is deactivated and a second position occupied by the stop lever when the motor is actuated, the first and second positions being located in relation to the program disc such that the pin on the stop lever protrudes into the path of the tabs on the program disc only when the stop lever occupies the second position.

8. A timer according to claim 7, further comprising a rotatable shaft, the pointer being mounted on the shaft for rotation therewith, and means for mounting the pin on the stop lever in such a manner that the pin pivots in one direction so that when the program disc rotates in the opposite direction any one of the tabs engaging the pin pivots the pin in the one direction away from the tab, whereby the stop lever is prevented from being actuated by the tabs when the pointer rotates in the opposite direction.

9. A timer according to claim 1, further comprising spring means for biasing the start lever into a rest position occupied by the start lever when the motor is stopped; and catch means, acting after the start lever has been moved out of the rest position and into an operating position in which the motor is actuated, for preventing the spring means from drawing the start lever back into the rest position until the stop lever is actuated by the trip mechanism.

10. A timer according to claim 9, wherein the catch means includes a lug on the stop lever and a projection on the start lever, the projection releasably engaging the lug when the start lever is in the operating position.

11. A timer according to claim 10, wherein the trip mechanism includes a trip lever having a cog, a disc mounted for movement with the pointer and having a recess on an outer edge, the trip lever and the disc being positioned such that the cog of the trip lever slides along the outer edge of the disc as the pointer runs back toward the zero position and mates with the recess in the disc when the pointer has run back to zero position to disengage the lug of the stop lever form the projection of the start lever so that the start lever is drawn back into the rest position by the spring means.

12. A timer according to claim 11, further comprising a second pointer driven by the motor through the transmission gear train, the second pointer being mounted for movement with the other pointer at an increased rate of speed to measure a time interval of smaller units, a second disc mounted for movement with the second pointer and having a recess on an outer edge, the second disc being positioned such that the cog of the trip lever slides along the outer edge of the second disc as the pointer runs back toward the zero position and mates with the recess in the second disk when the pointer has run back to the zero position to disengage the lug of the stop lever from the projection of the start lever so that the start lever is drawn back into the rest position by the spring means.

13. A timer according to claim 12, further comprising a notched disc mounted for movement with the second pointer and having a pair of notches on an outer edge, a follower lever positioned to slide along the outer edge of the notched disc as the second pointer moves with the other pointer and engage one of the notches when the second pointer reaches a predetermined position, and detent means for preventing the lug of the stop lever from disengaging the cog of the start lever until the follower lever engages one of the notches in the notched disc.

14. A timer according to claim 13, wherein the detent means comprises a pawl activated by the follower lever and having a lug engaging the projection of the start lever when the start lever is in the operating position.

15. A timer according to claim 14, further comprising a rotatable shaft, the pointers being mounted on the shaft for rotation therewith; and means for mounting the pawl in such a manner that the pawl pivots in one direction so that the lug of the pawl does not get caught in one of the notches in the notched disc when the notched disc rotates in the opposite direction.

16. A timer according to claim 1, wherein the transmission gear train includes a first pinion mounted on a shaft of the motor for rotation therewith, a first gear mounted on a displaceable shaft for rotation therewith, a second gear meshing with the first pinion and the first gear in such a manner that the first gear rotates in the same direction as the motor shaft, and a second pinion mounted on the motor shaft for rotation therewith.

17. A timer according to claim 16, wherein the switch means includes a leaf spring pivotable about one end, the other end engaging the displaceable shaft, and a pivotable switch lever slidably engaging the leaf spring to pivot the other end in such a manner that the displaceable shaft is displaced to disengage the first gear from the second gear and engage the first gear with the second pinion so that the first gear rotates in a direction opposite to that of the motor shaft, whereby the direction of rotation of the pointer may be reversed without reversing the direction of rotation of the motor shaft.

18. In a timer including a motor having a rotatable shaft; a first pinion mounted on the motor shaft for rotation therewith; a first gear mounted on a displaceable shaft for rotation therewith; a second gear meshing with the first gear and the first pinion in such a manner that the first gear rotates in the same direction as the motor shaft; a second pinion mounted on the motor shaft for rotation therewith; a pointer mounted on a shaft for rotation therewith, the pointer shaft being driven by the first gear through a transmission system and the pointer being settable to a predetermined position representing a desired time interval; a start lever for actuating the motor in such a manner that the pointer rotates toward a zero position from the predetermined position; and a trip mechanism for actuating a stop lever when the pointer has rotated back to the zero position to stop the motor; the improvement comprising:

switch means for selectively changing the direction of rotation of the pointer so that the pointer rotates away from the zero position, the switch means including a leaf spring pivotable about one end, the other end engaging the displaceable shaft, and a pivotable switch lever slidably engaging the leaf spring to pivot the other end in such a manner that the displaceable shaft is displaced to disengage the first gear from the second gear and engage the first gear with the second pinion so that the first gear rotates in a direction opposite to that of the motor shaft and slidably engaging the trip mechanism to prevent the actuation of the stop lever by the trip mechanism when the pointer rotates away from the zero position; and means for manually actuating the stop lever so that the motor can be stopped when the pointer rotates away from the zero position, whereby the timer is operable as a stop watch.

* * * * *